US009250563B2

(12) United States Patent
Funayama

(10) Patent No.: US 9,250,563 B2
(45) Date of Patent: Feb. 2, 2016

(54) IMAGE FORMING APPARATUS AND IMAGE FORMING METHOD

(71) Applicant: FUJI XEROX CO., LTD., Minato-ku, Tokyo (JP)

(72) Inventor: Yasuhiro Funayama, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/490,065

(22) Filed: Sep. 18, 2014

(65) Prior Publication Data

US 2015/0234312 A1 Aug. 20, 2015

(30) Foreign Application Priority Data

Feb. 19, 2014 (JP) ..... 2014-029668

(51) Int. Cl.
*G03G 21/00* (2006.01)
*G03G 15/06* (2006.01)

(52) U.S. Cl.
CPC ..... *G03G 15/065* (2013.01)

(58) Field of Classification Search
CPC ..... G03G 15/065
USPC ..... 399/55
See application file for complete search history.

(56) References Cited

U.S. PATENT DOCUMENTS 5,521,683 A * 5/1996 Miyamoto et al. ..... 399/55
6,163,663 A * 12/2000 Shinohara et al. ..... 399/55
2004/0047642 A1 3/2004 Kosuge

FOREIGN PATENT DOCUMENTS

JP 2003-241570 A 8/2003

* cited by examiner

*Primary Examiner* — David Gray
*Assistant Examiner* — Michael Harrison
(74) *Attorney, Agent, or Firm* — Sughrue Mion, PLLC

(57) ABSTRACT

An image forming apparatus includes an image carrier that rotates, a latent image forming unit that forms an electrostatic latent image on the image carrier, a developing unit that develops the electrostatic latent image formed on the image carrier, with a developer including a toner and an external additive, a transfer unit that transfers an image developed on the image carrier to a recording material, a cleaning member that cleans a residue remaining on the image carrier after transfer, a supply unit that supplies a developing bias, which has an alternating-current component superimposed on a direct-current component, between the image carrier and the developing unit, and a setting part that increases a peak-to-peak value of the alternating-current component of the developing bias when a non-image region on the image carrier passes a developing region, in comparison to when an image region on the image carrier passes the developing region.

7 Claims, 7 Drawing Sheets

IMAGE FORMING APPARATUS AND IMAGE FORMING METHOD

CROSS-REFERENCE TO RELATED APPLICATIONS

This application is based on and claims priority under 35 USC 119 from Japanese Patent Application No. 2014-029668 filed Feb. 19, 2014.

BACKGROUND

Technical Field

The present invention relates to an image forming apparatus and an image forming method.

SUMMARY

According to an aspect of the invention, there is provided an image forming apparatus including an image carrier that rotates, a latent image forming unit that forms an electrostatic latent image on the image carrier, a developing unit that develops the electrostatic latent image formed on the image carrier with a developer, the developer including a toner and an external additive added to the toner, a transfer unit that transfers an image developed on the image carrier to a recording material, a cleaning member that cleans a residue that remains on the image carrier after transfer, a supply unit that supplies a developing bias between the image carrier and the developing unit, the developing bias having an alternating-current component superimposed on a direct-current component, and a setting part that increases a peak-to-peak value of the alternating-current component of the developing bias when a non-image region on the image carrier passes a developing region facing the developing unit, in comparison to when an image region on the image carrier passes the developing region.

BRIEF DESCRIPTION OF THE DRAWINGS

Exemplary embodiment of the present invention will be described in detail based on the following figures, wherein.

DETAILED DESCRIPTION

Hereinafter, an exemplary embodiment of the present invention will be described in detail with reference to the attached figures.

Figure 1:
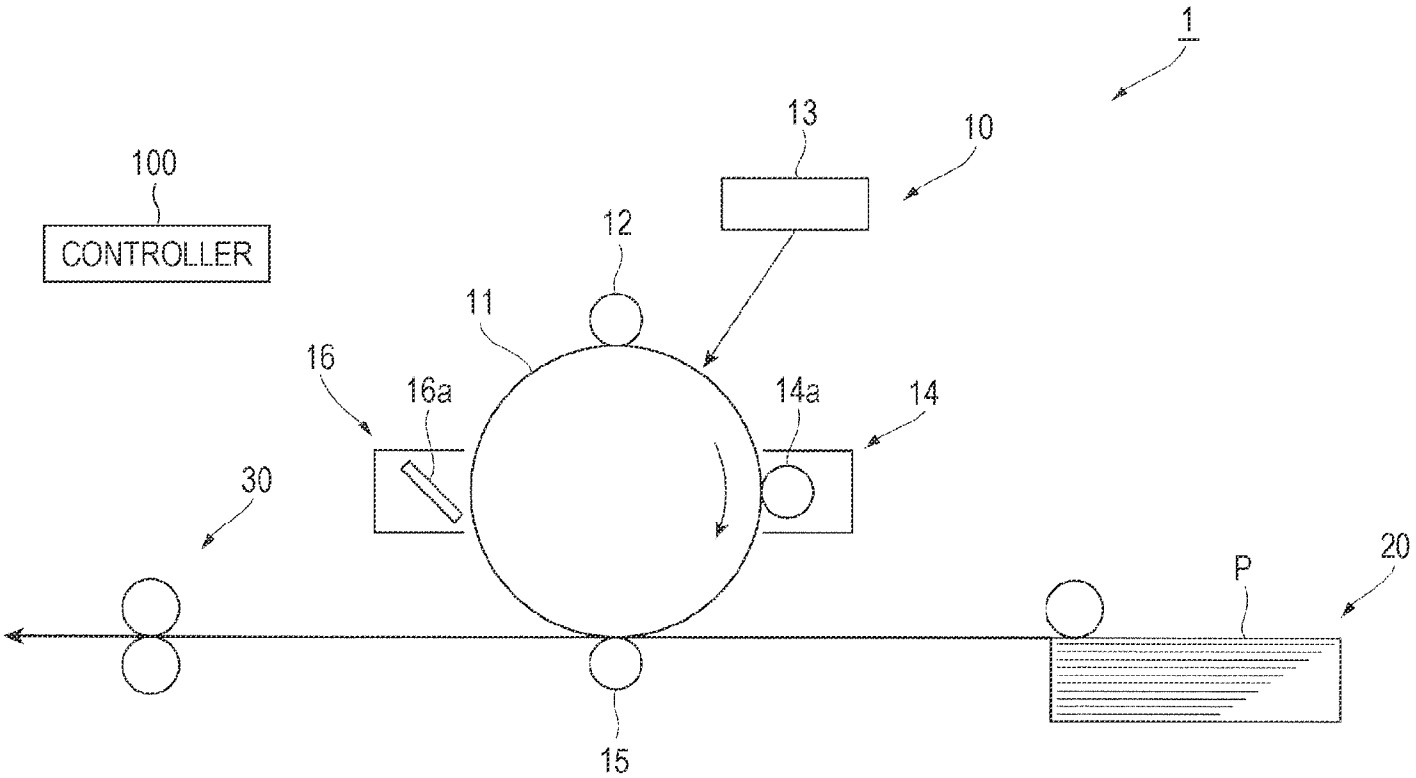
FIG. 1 illustrates a general configuration of an image forming apparatus according to an exemplary embodiment of the invention.

FIG. 1 illustrates a general configuration of an image forming apparatus 1 according to the exemplary embodiment.

The image forming apparatus 1 includes an image forming unit 10, a paper supply unit 20, a fixing unit 30, and a controller 100. The image forming unit 10 forms a toner image by the electrophotographic system. The paper supply unit 20 supplies paper P toward the image forming unit 10. The fixing unit 30 fixes an image (toner image) that is formed on the paper P by the image forming unit 10. The controller 100 controls operation of various units of the image forming apparatus 1.

Of the above-mentioned components, the image forming unit 10 has a photoconductor drum 11 that is rotatable in the direction indicated by an arrow in FIG. 1. The image forming unit 10 also has a charging roller 12, an exposure device 13, a developing device 14, a transfer roller 15, and a cleaning device 16, which are provided around the photoconductor drum 11 along the direction indicated by the arrow.

In the exemplary embodiment, the photoconductor drum 11 as an example of an image carrier has an organic photosensitive layer (not illustrated) formed on the surface of a thin-walled cylindrical drum made of metal. In this example, the organic photosensitive layer is made of a material that is charged to a negative polarity. Further, the photoconductor drum 11 is grounded.

The charging roller 12 is formed by, for example, a rubber roller having electrical conductivity, and is disposed so as to be rotatable while in contact with the photoconductor drum 11. The charging roller 12 rotates as the photoconductor drum 11 rotates. A charging bias for charging the photoconductor drum 11 to a negative potential is applied to the charging roller 12.

The exposure device 13 uses laser light or the like to selectively perform optical writing on the photoconductor drum 11 that has been charged to a negative potential by the charging roller 12, thereby forming an electrostatic latent image. At this time, the exposure device 13 according to the exemplary embodiment performs exposure by a so-called image portion exposure system, in which areas (image portion) that become a toner image (image) are irradiated with light, and areas (background portion) that become the background are not irradiated with light. Other than a laser light source, a light emitting diode (LED) light source may be used as a light source for the exposure device 13. In the exemplary embodiment, the charging roller 12 and the exposure device 13 each function as an example of a latent image forming unit.

The developing device 14 as an example of a developing unit includes a developing roller 14*a* that is rotatably disposed facing the photoconductor drum 11. The developing device 14 contains a developer including a toner of a predetermined color (for example, black). As the developer, the developing device 14 according to the exemplary embodiment uses a so-called two-component developer including a carrier having magnetic property, and a toner that is colored in a predetermined color in advance. In the developer, the carrier has a positive charge polarity, and the toner has a negative charge polarity. The developing roller 14*a* has a built-in magnet (not illustrated), which causes the carrier with the toner adhered thereto by an electrostatic force, that is, the developer, to be held on the surface of the developing roller 14*a* by a magnetic force. In the developing device 14, the electrostatic latent image on the photoconductor drum 11 is developed with the developer (toner) held on the developing roller 14*a*. The developing device 14 develops an image by a so-called reversal development system, in which a developing bias for placing a negative potential on the developing roller 14*a* is supplied to thereby transfer the negatively charged toner to the image portion that is the negatively charged portion of the electrostatic latent image.

The transfer roller 15 as an example of a transfer unit is formed by, for example, a rubber roller having electrical conductively, and is disposed so as to be rotatable while in contact with the photoconductor drum 11. The transfer roller 15 rotates as the photoconductor drum 11 rotates. A transfer bias having a polarity (positive polarity in this example) opposite to the polarity of the charge on the toner is applied to the transfer roller 15.

The cleaning device 16 is provided so as to extend along the outer circumferential surface of the photoconductor drum 11, in a direction crossing the rotational direction of the photoconductor drum 11. The cleaning device 16 includes a cleaning blade 16*a*. The cleaning blade 16*a* projects in a direction (doctor direction) opposite to the rotational direction of the photoconductor drum 11, and is disposed in such a way that the distal end portion of the projecting side of the cleaning blade 16*a* abuts against the outer circumferential surface of the photoconductor drum 11. The cleaning blade 16*a* as an example of a cleaning member is formed by, for example, a rubber material such as urethane rubber. The cleaning blade 16*a* removes deposits (such as toner) that are present on the photoconductor drum 11 after transfer and before charging.

The paper supply unit 20 according to the exemplary embodiment includes, for example, a storage container that stores paper P, a feed mechanism that feeds the paper P from the storage container, and a transport mechanism that transports the paper P being fed, to the outside via the part (transfer part) of the image forming unit 10 where the photoconductor drum 11 and the transfer roller 15 face each other, and the fixing unit 30.

The fixing unit 30 according to the exemplary embodiment includes a pair of rotators that rotate while in contact with each other. At least one of the two rotators is heated, and the paper P is passed through a fixing nip part formed between the two rotators, thereby causing the image on the paper P to be fixed in place.

Figure 2:
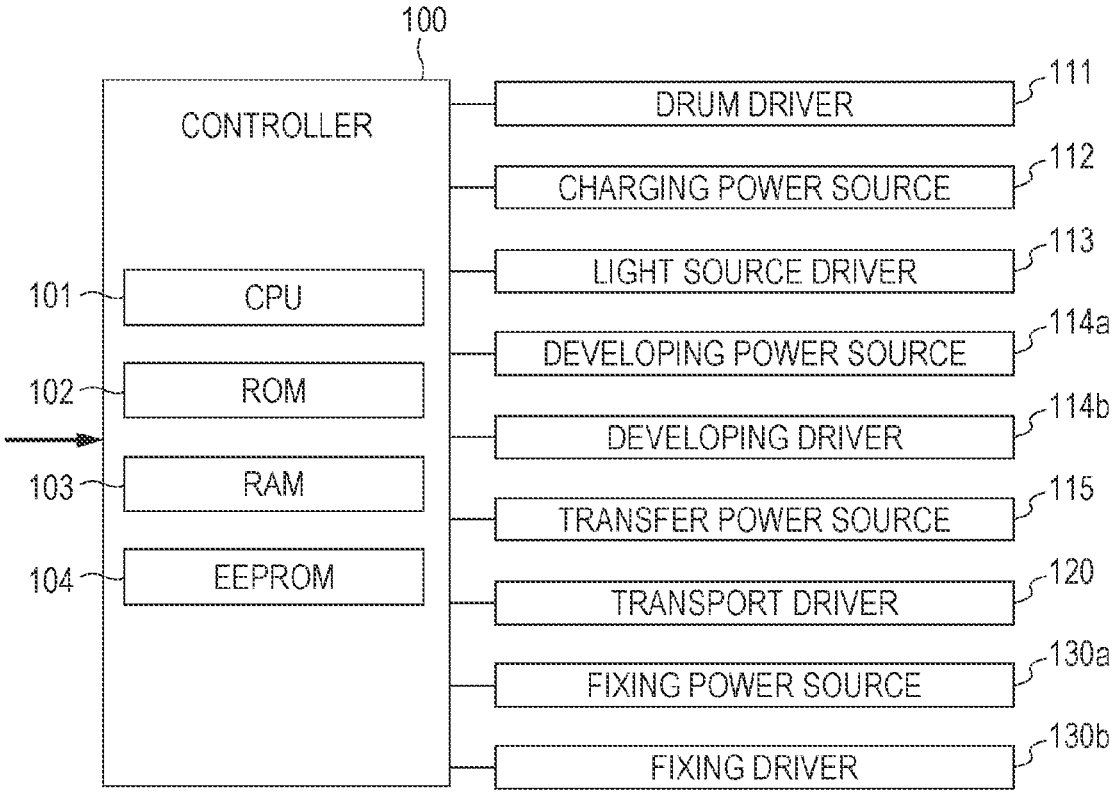
FIG. 2 is a block diagram for explaining a configuration of a control system in an image forming apparatus.

FIG. 2 is a block diagram for explaining a configuration of a control system in the image forming apparatus 1 according to the exemplary embodiment.

The controller 100 as an example of a setting part includes a central processing unit (CPU) 101, a read only memory (ROM) 102, a random access memory (RAM) 103, and an electrically erasable programmable read-only memory (EEPROM) 104. The CPU 101 reads and executes a program. The ROM 102 stores a program executed by the CPU 101, and data or the like used when executing the program. The RAM 103 stores data and the like temporarily generated when executing a program. The EEPROM 104 stores data or the like used when executing a program. Further, the EEPROM 104 allows rewriting of its contents, and is capable of retaining stored information even without supply of power.

The controller 100 outputs a control signal to each of a drum driver 111 that rotationally drives the photoconductor drum 11, a charging power source 112 that supplies a charging bias to the charging roller 12, and a light source driver 113 that drives a light source provided in the exposure device 13. The controller 100 also outputs a control signal to each of a developing power source 114*a* that supplies a developing bias to the developing roller 14*a* provided in the developing device 14, and a developing driver 114*b* that rotationally drives the developing roller 14*a*. Further, the controller 100 outputs a control signal to each of a transfer power source 115 that supplies a transfer bias to the transfer roller 15, a transport driver 120 that drives a transport system for the paper P which includes the paper supply unit 20, a fixing power source 130*a* that supplies heating electric power to the rotators of the fixing unit 30, and a fixing driver 130*b* that rotationally drives the rotators of the fixing unit 30. Various instructions, image data, and the like are inputted to the controller 100 from apparatuses (such as a computer apparatus and a scanner apparatus) provided outside the image forming apparatus 1.

In the exemplary embodiment, the charging power source 112 supplies a charging bias to the charging roller 12. The charging bias has an alternating-current (AC) component superimposed on a direct-current (DC) component that is set to a negative value. In the following description, the DC component of the charging bias will be referred to as DC charging bias, and the AC component of the charging bias will be referred to as AC charging bias. The DC charging bias is used to charge the organic photosensitive layer provided on the photoconductor drum 11 to a target potential (referred to as charge potential), and the AC charging bias is used to aid in the charging of the organic photosensitive layer by the DC charging bias.

In the exemplary embodiment, the developing power source 114*a* as an example of a supply unit supplies a developing bias to the developing roller 14*a*. The developing bias has an AC component superimposed on a DC component that is set to a negative value. In the following description, the DC component of the developing bias will be referred to as DC developing bias, and the AC component of the developing bias will be referred to as AC developing bias. The DC developing bias is used to move toner to the organic photosensitive layer (more specifically, the image portion) provided on the photoconductor drum 11, and the AC developing bias is used to aid in the movement of toner by the DC developing bias from the developing roller 14*a* to the inorganic photosensitive layer.

In the exemplary embodiment, the controller 100 controls the transfer bias supplied from the transfer power source 115 to the transfer roller 15 to a constant current or constant voltage. While basically the transfer bias may be any bias including a DC component, the transfer bias may further include an AC component superimposed on the DC component.

Figure 3A:
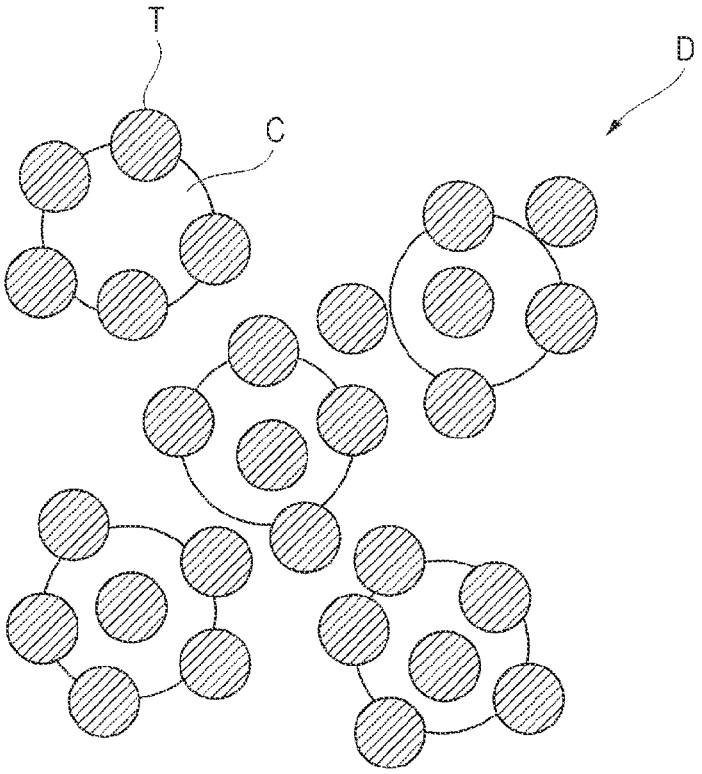
FIG. 3A illustrates a carrier and a toner that constitute a developer.
Figure 3B:
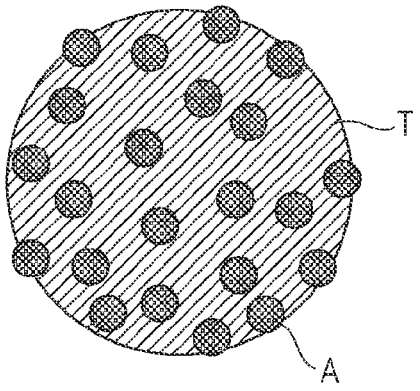
FIG. 3B illustrates a toner and an external additive included in a developer.

FIGS. 3A and 3B illustrate a developer D used in the exemplary embodiment.

As illustrated in FIG. 3A, the developer D according to the exemplary embodiment includes a carrier C having magnetic property, and a toner T that is colored in black, for example. The developer D further includes an external additive A that is added onto the toner T as illustrated in FIG. 3B.

As the carrier C of the developer D, a carrier having magnetic property and also having the characteristic of being positively charged is used. As such a carrier, ferrite beads with an average particle size of approximately 35 μm are used.

The toner T of the developer D has the characteristic of being negatively charged. The toner T is made up of fine particles with a coloring agent and wax internally added into a binder resin such as polyester or styrene acrylic by a method such as suspension polymerization, emulsion aggregation coalescence, or dissolution suspension. The toner T has a particle diameter of approximately 6.4 μm as measured by the Coulter counter (manufactured by Coulter Electronics Ltd.). From the viewpoint of forming good images, the volume average particle size of the toner T may fall within the range of 3 μm to 10 μm.

Further, as the external additive A of the developer D, inorganic fine particles with an average particle diameter of 5 nm to 200 nm such as silica ($SiO_2$), titania ($TiO_2$), and ceria ($CeO_2$) are used. As for the external additive A, silica with an average particle size set to 100 nm is added onto the toner T at 1.48% by weight. In addition to the silica, titania and ceria are added at 0.8% by weight and 0.7% by weight, respectively. In this example, the silica constituting the external additive A has the same charge polarity (negative polarity) as the toner T. After moving from the developing device 14 (the developing roller 14*a*) onto the photoconductor drum 11, the external additive A reaches the contact part (hereinafter, referred to as cleaning position) between the photoconductor drum 11 and the cleaning blade 16*a*, thus functioning as a lubricant between the photoconductor drum 11 and the cleaning blade 16*a*.

Figure 4:
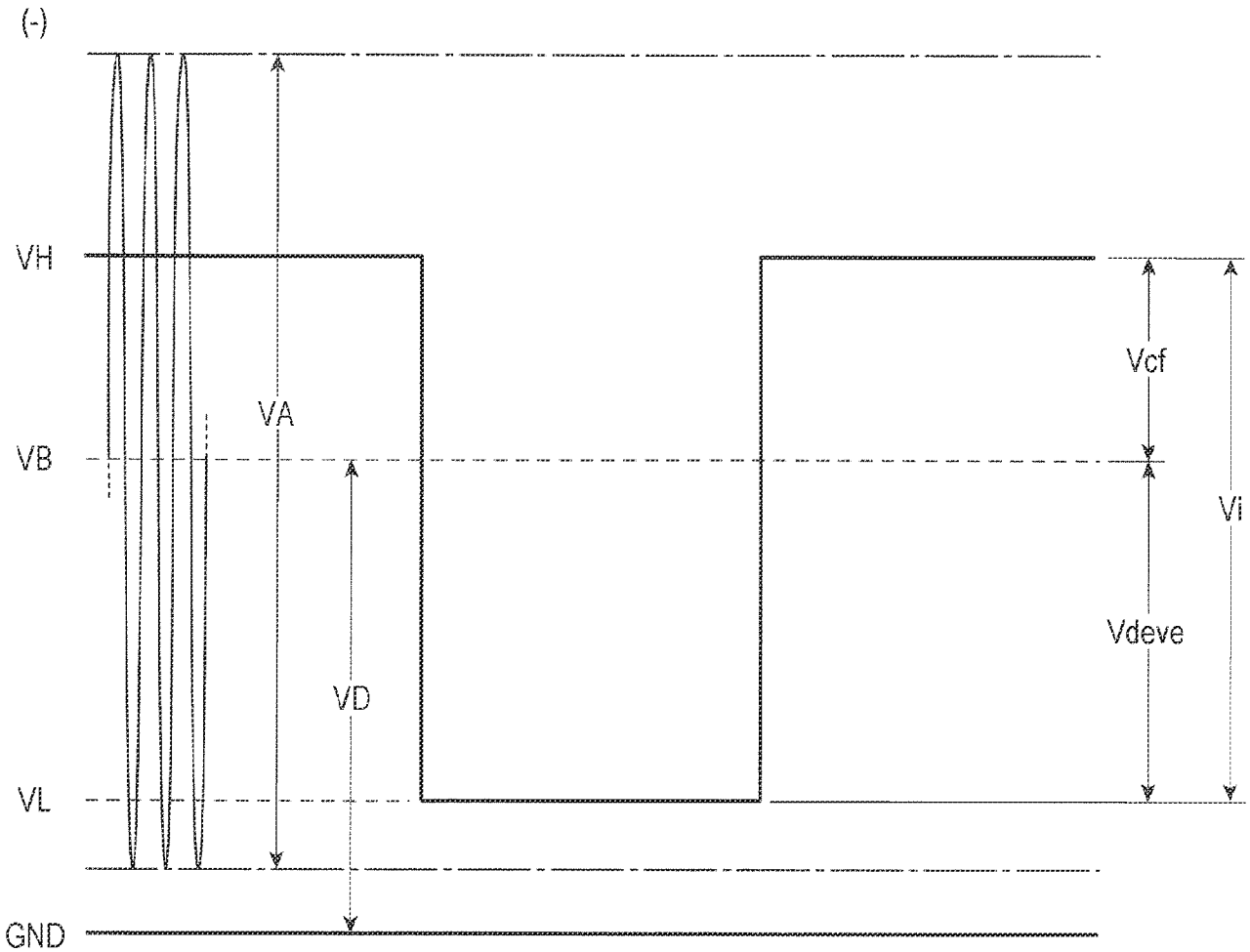
FIG. 4 is a chart for explaining the relationship between a charging potential and an exposure potential in a photoconductor drum, and a developing potential in a developing device.

FIG. 4 is a chart for explaining the relationship between a charging potential VH and an exposure potential VL in the photoconductor drum 11, and a developing potential VB in the developing device 14 (more specifically, the developing roller 14*a*). In FIG. 4, the horizontal axis represents a position on the photoconductor drum 11, and the vertical axis represents potential (the bottom being the ground (GND); the higher along the vertical axis, the higher the value of negative potential). The charging potential VH is determined by the magnitude of a DC charging bias in the above-mentioned charging bias (DC charging bias and AC charging bias), and the exposure potential VL is determined by the charging bias and the energy of exposure by the exposure device 13. Further, the developing potential VB is determined by the magnitude of a DC developing bias VD of the above-mentioned developing bias (DC developing bias VD and AC developing bias VA). While FIG. 4 depicts the magnitude of the AC developing bias VA of the developing bias, the magnitude of the AC developing bias VA is represented by its peak-to-peak value because the AC developing bias VA is an alternating-current bias.

In the exemplary embodiment, the charging potential VH and the exposure potential VL both have a negative polarity. In this regard, the magnitude of the exposure potential VL is less than that of the charging potential VH in absolute value ($|VL|<|VH|$). Further, the developing potential VB, that is, the DC developing bias VD according to the exemplary embodiment has a negative polarity value, and its absolute value is set to a magnitude between the charging potential VH and the exposure potential VL ($|VL|<|VB|<|VH|$).

In a case where the charging potential VH, the exposure potential VL, and the developing potential VB have the above-mentioned relationship, as the toner T (negatively charged) on the developing roller 14*a* passes a developing region where the photoconductor drum 11 and the developing roller 14*a* face each other, the toner T readily moves (flies) to the region of the exposure potential VL (image portion) which has a relatively positive potential on the photoconductor drum 11, but the toner T does not readily move (fly) to the region of the charging potential VH (background portion) which has a relatively negative potential on the photoconductor drum 11. However, the carrier C of the developer D is magnetically held on the developing roller 14*a*, and hence there is actually hardly any movement of the carrier C. In the following description, with the ease of flight of the toner T taken as a criterion, the difference between the exposure potential VL and the developing potential VB with reference to the exposure potential VL will be referred to as flight potential difference Vdeve, and the difference between the developing potential VB and the charging potential VH with reference to the developing potential VB will be referred to as reverse flight potential difference Vcf. Further, the difference between the exposure potential VL and the charging potential VH with reference to the exposure potential VL will be referred to as latent image potential difference Vi. The latent image potential difference Vi may be expressed as the sum of the flight potential difference Vdeve and the reverse flight potential difference Vcf.

Next, a description will be given of an image forming operation that forms an image on the paper P by using the image forming apparatus illustrated in FIG. 1.

In the image forming unit 10, the photoconductor drum 11 that rotates in the direction indicated by the arrow is charged to the charging potential VH by a charging bias supplied to the charging roller 12 that contacts the photoconductor drum 11. Next, exposure by the exposure device 13 is started. The photoconductor drum 11, which rotates while being charged to the charging potential VH, has its image portion selectively exposed to light emitted from the exposure device 13. As a result, an electrostatic latent image is formed on the organic photosensitive layer that has been charged and exposed as mentioned above, with the background portion being at the charging potential VH and the image portion being at the exposure potential VL.

Subsequently, as the photoconductor drum 11 rotates, the electrostatic latent image formed on the photoconductor drum 11 reaches the developing region facing the developing roller 14*a* provided in the developing device 14. At this time, the developing roller 14*a* is rotating while holding, on its surface, the developer D including the carrier C, the toner T, and the external additive A. Further, owing to the developing bias supplied to the developing roller 14*a*, the developing roller 14*a* is set to the developing potential VB. This causes the toner T to selectively move from the developing roller 14*a* to the image portion of the electrostatic latent image on the photoconductor drum 11 which is at the exposure potential VL. At this time, the external additive A adhering on the toner T also moves to the image portion together with the toner T. As a result, a toner image corresponding to the electrostatic latent image is developed on the photoconductor drum 11 that has passed the developing region.

As the photoconductor drum 11 rotates, the toner image developed on the photoconductor drum 11 in this way moves toward a transfer position facing the transfer roller 15.

Meanwhile, the paper P drawn out from the paper supply unit 20 is transported to the transfer position by the feed mechanism (not illustrated), in synchronism with the timing at which the toner image on the photoconductor drum 11 reaches the transfer position.

Thereafter, as the photoconductor drum 11 rotates, the toner image developed on the photoconductor drum 11 reaches the transfer position facing the transfer roller 15. At this time, as the transfer bias is supplied to the transfer roller 15, the toner image formed on the photoconductor drum 11 is transferred (electrostatically transferred) onto the paper P that passes the transfer position. As the photoconductor drum 11 further rotates, deposits such as toner remaining on the photoconductor drum 11 after the transfer reach the portion of the photoconductor drum 11 facing the cleaning blade 16*a* provided in the cleaning device 16, and are removed by the cleaning blade 16*a*.

In this way, according to the exemplary embodiment, during the image forming operation that forms an image on the paper P, the external additive A is moved together with the toner T to an area on the photoconductor drum 11 which becomes the image portion. While a part of the external additive A that has moved onto the photoconductor drum 11 is transferred to the paper P together with the toner T at the transfer position, the remainder of the external additive A passes the transfer position and reaches the cleaning position, and functions as a lubricant between the photoconductor drum 11 and the cleaning blade 16*a*.

However, in the case of successively forming images with low toner coverage ratio, in other words, images that are nearly blank in the image forming operation on the paper P, the amount of the toner T that moves from the developing device 14 to the image portion on the photoconductor drum 11 decreases, which also causes the amount of the external additive A moving to the image portion on the photoconductor drum 11 to decrease accordingly. As a result, the amount of the external additive A reaching the cleaning position also decreases, resulting in reduced lubrication between the photoconductor drum 11 and the cleaning blade 16*a*, which in turn exacerbates wear of the outer circumferential surface of the photoconductor drum 11 and the cleaning blade 16*a*.

Accordingly, in the exemplary embodiment, the external additive A is supplied from the developing device 14 to the photoconductor drum 11 under such a condition. It is to be noted, however, that in the exemplary embodiment, instead of supplying the external additive A together with the toner T from the developing device 14 to the photoconductor drum 11, the external additive A may be selectively supplied.

Figure 5:
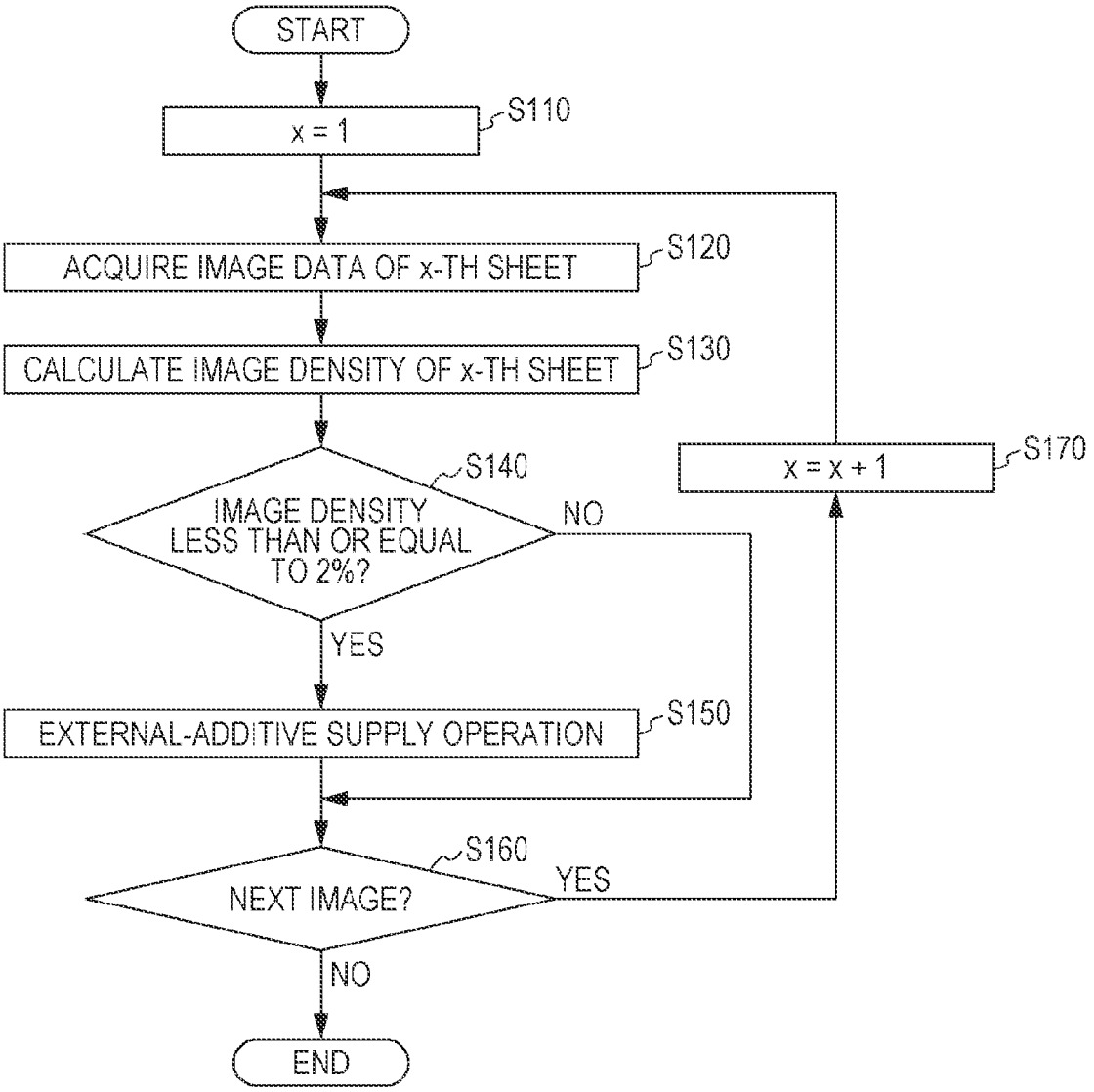
FIG. 5 is a flowchart illustrating the procedure of a process that determines whether or not to supply an external additive to a photoconductor drum.

FIG. 5 is a flowchart illustrating the procedure of a process that determines whether or not to supply an external additive to the photoconductor drum 11.

In this process, when an image forming operation on the paper P begins, the controller 100 sets the number of sheets (sheet count) x of the paper P to 1 (step 110). Then, the controller 100 acquires the image data of the x-th sheet which serves as the original of the image to be formed on the x-th sheet (initially the first sheet) of the paper P (step 120). Next, on the basis of the acquired image data of the x-th sheet, the controller 100 calculates the area coverage of the x-th sheet (step 130), and determines whether or not the obtained area coverage is less than or equal to 2% (step 140).

At this time, the area coverage is expressed as the proportion of pixels on which to form a toner image, relative to the total pixel count obtained when image data for one sheet (x-th sheet) of the paper P is developed into pixel data.

In a case where the determination in step 140 is positive (YES), the controller 100 causes an external-additive supply operation to be executed, in which the external additive A is supplied from the developing device 14 to the photoconductor drum 11 (step 150), and then proceeds to the next step 160. In a case where the determination in step 140 is negative (NO), the controller 100 directly proceeds to step 160, without causing the external-additive supply operation to be executed. Next, the controller 100 determines whether or not an image corresponding to the next sheet of the paper P exists, that is, whether or not the next image exists (step 160).

In a case where the determination in step 160 is positive (YES), the controller 100 sets the sheet count x of the paper P to x+1 (step 170), and returns to step 120 to continue the processing. In a case where the determination in step 160 is negative (NO), the controller 100 ends the series of processing.

Now, the external-additive supply operation according to the exemplary embodiment will be described in more detail.

Figure 6:
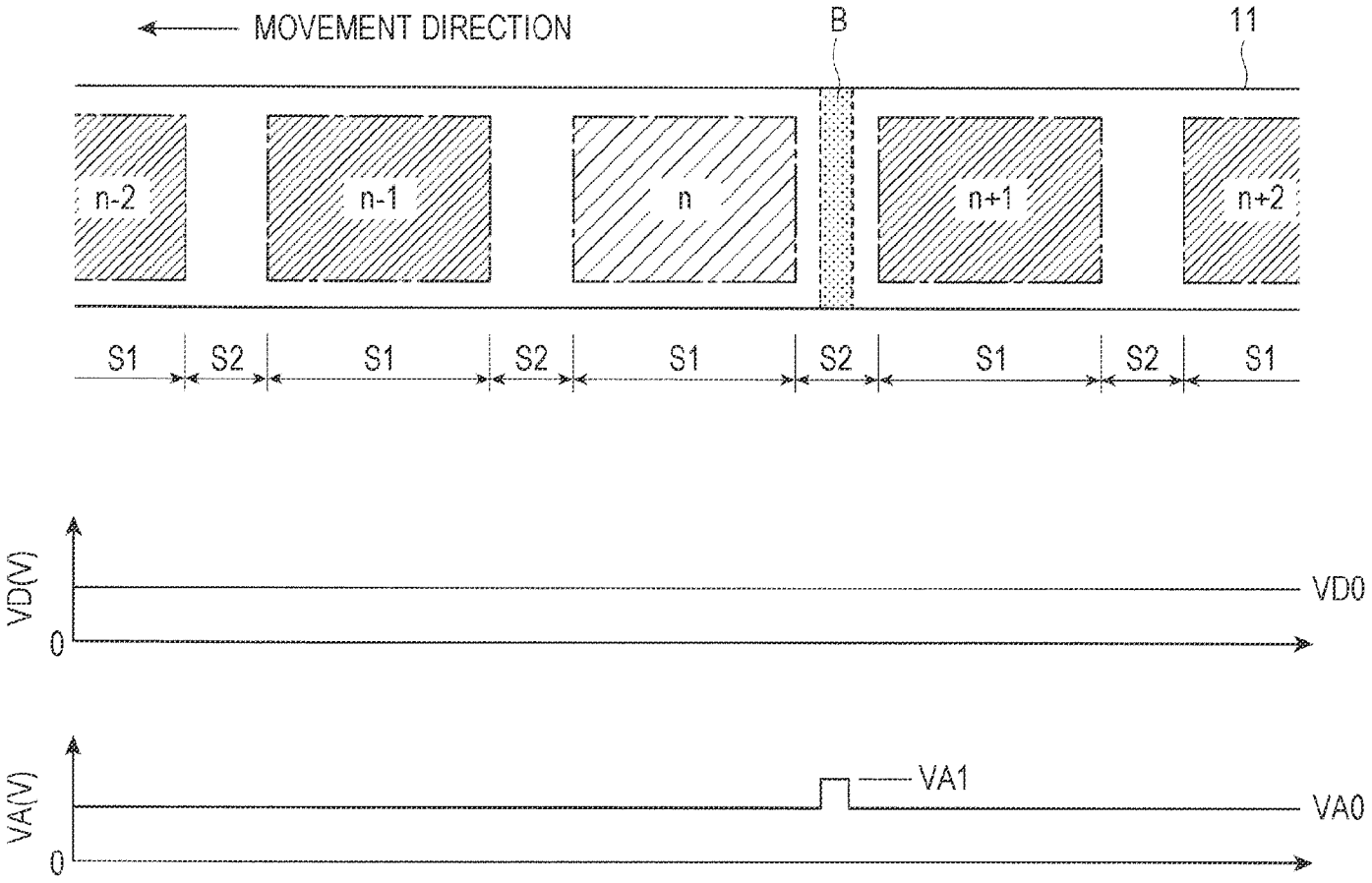
FIG. 6 is a timing chart for explaining an example of how to set a developing bias in the case of successively forming images on multiple sheets of paper.

FIG. 6 is a timing chart for explaining an example of how to set the developing bias (DC developing bias VD and AC developing bias VA) in the case of successively forming images on multiple sheets of the paper P. FIG. 6 illustrates a state in which images corresponding to multiple sheets ( . . . , the (n−2)-th sheet, the (n−1)-th sheet, the n-th sheet, the (n+1)-th sheet, the (n+2)-th sheet, . . . ) of the paper P are successively formed on the outer circumferential surface of the photoconductor drum 11. In the following description, with respect to the direction of movement of the photoconductor drum 11, a region in which the image to be transferred to the paper P may be formed will be referred to as image region S1, and a region located between the image region S1 and the next image region S1 will be referred to as inter-image region S2 (corresponding to a non-image region). Further, in this example, it is assumed that a negative determination (NO) has been made in step 140 illustrated in FIG. 5 for the respective pieces of image data corresponding to the (n−2)-th sheet, the (n−1)-th sheet, the (n+1)-th sheet, and the (n+2)-th sheet of the paper P, and a positive determination (YES) has been made in step 140 illustrated in FIG. 5 for the image data correspond to the n-th sheet of the paper P. It is also assumed that during execution of the image forming operation, the charging potential VH and the exposure potential VL are set to, for example, −650 V and −200 V, respectively.

While the image forming operation is executed, the magnitude of the DC developing bias VD is set to a DC normal value VD0=−500 V. Further, while the image forming operation is executed, the magnitude (peak-to-peak value) of the AC developing bias VA is basically set to an AC normal value VA0=700 V. While the AC developing bias VA has a frequency selected from the range of 3 kHz or more to 9 kHz or less, the frequency of the AC developing bias VA is set to 7 kHz in this example.

However, in a case where the determination in step 140 illustrated in FIG. 5 is positive (YES), when the inter-image region S2 that follows the image region S1 corresponding to this sheet of the paper P passes the developing region, the magnitude of the AC developing bias VA is changed to an AC special value VA1=1000 V that is greater than the AC normal value VA0. The magnitude of the DC developing bias VD at this time is maintained at the DC normal value VD0.

When the AC developing bias VA is increased in this way, the amount of the external additive A that moves from the developing device 14 (the developing roller 14*a*) to the photoconductor drum 11 in the developing region increases. As a result, an external-additive band B is formed in the inter-image region S2 on the photoconductor drum 11. In the external-additive band B, a large amount of the external additive A is disposed in a band-like fashion in a direction that crosses the movement direction of the photoconductor drum 11. Then, the external-additive band B formed on the photoconductor drum 11 reaches the cleaning position after passing the transfer position. At this time, while the external-additive band B formed in the inter-image region S2 passes the transfer position, application of the transfer bias to the transfer roller 15 is stopped. This makes it possible to minimize movement of the external additive A forming the external-additive band B to the transfer roller 15, in other words, minimize a decrease in the amount of the external additive A that reaches the cleaning position.

In this example, the DC developing bias VD is maintained at the DC normal value VD0 even during the time when the magnitude of the AC developing bias VA is changed (increased) from the AC normal value VA0 to the AC special value VA1 in the inter-image region S2. Consequently, there is hardly any movement of the toner T from the developing device 14 to the photoconductor drum 11 in the inter-image region S2.

Figure 7:
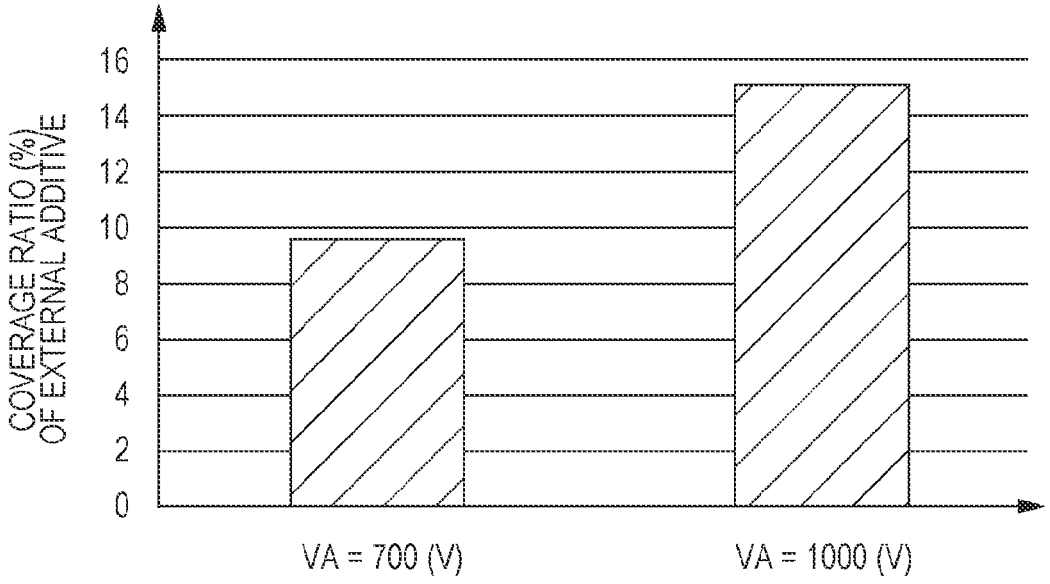
FIG. 7 illustrates the relationship between the magnitude of an alternating-current developing bias and the coverage ratio of an external additive on a photoconductor drum.

FIG. 7 illustrates the relationship between the magnitude of the AC developing bias VA and the coverage ratio of the external additive A on the photoconductor drum 11. In FIG. 7, the left-hand side of FIG. 7 illustrates a case where the AC developing bias VA is set to 700 V (peak-to-peak value), and the right-hand side of FIG. 7 illustrates a case where the AC developing bias VA is set to 1000 V (peak-to-peak value). That is, the left-hand side of FIG. 7 corresponds to a case where the AC developing bias VA is set to the AC normal value VA0, and the right-hand side of FIG. 7 corresponds to a case here the AC developing bias VA is set to the AC special value VA1. In the example illustrated in FIG. 7, the photoconductor drum 11 is set to the charging potential VH (−650 V), and the DC normal value VD0 (−500 V) is applied to the developing roller 14*a* as the DC developing bias VD.

As illustrated in FIG. 7, in a case where the AC developing bias VA is set to 700 V, the coverage ratio of the external additive A on the photoconductor drum 11 is about 9.5%. In contrast, in a case where the AC developing bias VA is set to 1000 V, the coverage ratio of the external additive A on the photoconductor drum 11 increases to about 15%. That is, increasing the AC developing bias VA makes it possible to increase the amount of the external additive A that moves from the developing device 14 side to the photoconductor drum 11 side. Therefore, a greater amount of the external additive A may be supplied to the cleaning position where the photoconductor drum 11 and the cleaning blade 16*a* contact each other, thereby reducing wear of the photoconductor drum 11 and the cleaning blade 16*a*.

While the AC normal value VA0 of the AC developing bias VA is set to 700 V and the AC special value VA1 of the AC developing bias VA is set to 1000 V in the exemplary embodiment, this is not to be construed restrictively. It suffices that the AC special value VA1 be at least greater than the AC normal value VA0. However, in a case where a two-component developer including the carrier C is used as the developer D as in the exemplary embodiment, making the AC special value VA1 too large relative to the AC normal value VA0 may cause the carrier C to move from the developing roller 14*a* to the photoconductor drum 11 owing to the AC developing bias VA. Accordingly, in order to minimize movement of the carrier C, the magnitude of the AC special value VA1 may be set to lower than or equal to approximately twice the AC normal value VA0. When an image forming operation is performed with a large amount of the external additive A adhering on the photoconductor drum 11, the density of the resulting toner image differs between an area where the amount of adhering external additive A is large and an area where the amount of adhering external additive A is small, which may cause density unevenness called ghost. Accordingly, in order to minimize ghost, the magnitude of the AC special value VA1 may be set to lower than or equal to 1.5 times the AC normal value VA0.

In a case where the technique according to the exemplary embodiment is used, the external-additive band B may form on the photoconductor drum 11 multiple times. In such a case, the position at which to form the external-additive band B on the photoconductor drum 11 may be made to differ between the current time and the last time. By adopting this configuration, it is possible to minimize unevenness in the density of the external additive A on the photoconductor drum 11.

Further, in the exemplary embodiment, the peak-to-peak value is changed but the frequency is not changed between when the AC developing bias VA has the AC normal value VA0 and when the AC developing bias VA has the AC special value VA1. However, this is not to be construed restrictively. The frequency may be made to differ between the AC normal value VA0 and the AC special value VA1. In particular, making the frequency of the AC special value VA1 lower than the frequency of the AC normal value VA0 makes it possible to minimize an increase in the required capacity of the developing power source 114*a*.

While the exemplary embodiment is directed to the case where a two-component developer including the carrier C, the toner T, and the external additive A is used as the developer D, this is not to be construed restrictively. For example, the exemplary embodiment is also applicable to a case where a single-component developer that includes the toner T and the external additive A but does not include the carrier C is used as the developer D.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image carrier configured to rotate;

a latent image forming unit configured to form an electrostatic latent image on the image carrier;

a developing unit configured to develop the electrostatic latent image formed on the image carrier with a developer, the developer including a toner and an external additive added to the toner;

a transfer unit configured to transfer an image developed on the image carrier to a recording material;

a cleaning member configured to clean a residue that remains on the image carrier after transfer;

a supply unit configured to supply a developing bias between the image carrier and the developing unit, the developing bias having an alternating-current component superimposed on a direct-current component; and a setting part configured to increase a peak-to-peak value of the alternating-current component of the developing bias when a non-image region on the image carrier passes a developing region facing the developing unit, in comparison to when an image region on the image carrier passes the developing region, and maintain a magnitude of the direct-current component of the developing bias when the non-image region on the image carrier passes the developing region facing the developing unit, in comparison when the image region on the image carrier passes the developing region.

2. The image forming apparatus according to claim 1, wherein in a case where the developer further includes a carrier, when the non-image region on the image carrier passes the developing region, the setting part is further configured to set the peak-to-peak value of the alternating-current component to less than or equal to approximately twice the peak-to-peak value of the alternating-current component supplied when the image region on the image carrier passes the developing region.

3. The image forming apparatus according to claim 1, wherein the setting part is further configured to set a circumferential position on the image carrier for which to increase the peak-to-peak value of the alternating-current component to a position different from a last position.

4. The image forming apparatus according to claim 1, wherein when the non-image region on the image carrier passes the developing region, the setting part is further configured to lower a frequency of the alternating-current component of the developing bias in comparison to when the image region on the image carrier passes the developing region.

5. The image forming apparatus according to claim 1, wherein on a basis of currently amended data of an image to be formed on the image carrier, the setting part is further configured to increase the peak-to-peak value of the alternating-current component of the developing bias in a case where an area coverage of the image is less than or equal to a predetermined reference value.

6. An image forming method comprising:

forming an electrostatic latent image on an image carrier that rotates;

developing the electrostatic latent image formed on the image carrier with a developer, the developer including a toner and an external additive added to the toner;

transferring an image developed on the image carrier to a recording material;

cleaning a residue that remains on the image carrier after the transferring;

supplying a developing bias between the image carrier and the developing unit, the developing bias having an alternating-current component superimposed on a direct-current component;

increasing a peak-to-peak value of the alternating-current component of the developing bias when a non-image region on the image carrier passes a developing region facing the developing unit, in comparison to when an image region on the image carrier passes the developing region; and maintaining a magnitude of the direct-current component of the developing bias when the non-image region on the image carrier passes the developing region facing the developing unit, comparison to when the image region on the image carrier passes the developing region.

7. An image forming apparatus comprising:

an image carrier configured to rotate;

a latent image forming unit configured to form an electrostatic latent image on the image carrier;

a developing unit configured to develop the electrostatic latent image formed on the image carrier with a developer, the developer including a toner and an external additive added to the toner;

a transfer unit configured to transfer an image developed on the image carrier to a recording material;

a cleaning member configured to clean a residue that remains on the image carrier after transfer;

a supply unit configured to supply a developing bias between the image carrier and the developing unit, the developing bias having an alternating-current component superimposed on a direct-current component; and a setting part configured to maintain a peak-to-peak value of the alternating-current component for an image region and a non-image region on the image carrier, except when the image region preceding the non-image region has a coverage area that is less than or equal to a predetermined reference value in which case the setting part increases the peak-to-peak alternating-current component of the developing bias when the non-image region passes a developing region facing the developing unit.

* * * * *